US005163189A

United States Patent [19]

DeGray

[11] Patent Number: 5,163,189

[45] Date of Patent: Nov. 17, 1992

[54] MECHANICAL GURNEY

[76] Inventor: William G. DeGray, P.O. Box 36, Port Isabel, Tex. 78578

[21] Appl. No.: 785,053

[22] Filed: Oct. 30, 1991

[51] Int. Cl.[5] ..... A61G 7/10

[52] U.S. Cl. ..... 5/86.1; 5/81.1; 180/19.2

[58] Field of Search ..... 5/81.1, 86.1, 84.1, 5/600, 607, 611; 180/19.2

[56] References Cited

U.S. PATENT DOCUMENTS

| | | | |
|---|---|---|---|
| 2,691,782 | 10/1954 | West | 5/81.1 |
| 3,945,063 | 3/1976 | Matsuura | 5/611 |
| 3,967,328 | 7/1976 | Cox | 5/81.1 |
| 4,220,241 | 9/1980 | DeGray | 198/408 |
| 4,747,170 | 5/1988 | Knouse | 5/81.1 |
| 4,761,841 | 8/1988 | Larsen | 5/81.1 |
| 4,794,655 | 1/1989 | Ooka et al. | 5/81.1 |

*Primary Examiner*—Alexander Grosz

*Attorney, Agent, or Firm*—Jacobson, Price, Holman & Stern

[57] ABSTRACT

A mobile, self powered and power steered gurney is provided including an elevatable and laterally tiltable support structure from which patient support structure is supported for adjusted shifting laterally of the gurney between a first position superposed over the support structure and an extended position projecting outwardly of one side margin of the support structure. The patient support structure incorporates a conveyor structure which is operative to convey a patient laterally of the support structure responsive to shifting of the patient support structure further operative to shift a patient laterally of the patient support structure relative thereto in a direction opposite to the direction in which the patient support structure is being shifted relative to the support structure and at a speed substantially equal to the speed of shifting of the patient support structure relative to the support structure.

14 Claims, 4 Drawing Sheets

MECHANICAL GURNEY

BACKGROUND OF THE INVENTION

1. Field of the Invention

This invention relates to a mobile, self powered and mechanically steerable gurney of the type specifically designed to engage underneath, support and transfer a patient from a hospital bed to another location such as an operating theater or treatment room and to also transfer the patient back to his or her hospital bed.

2. Description of Related Art

Various different forms of mechanical gurneys, patient transfer devices and other similar structure heretofore have been provided including some of the general structural and operational features of the instant invention. Examples of these previously known structures are disclosed in U.S. Pat. Nos. 2,691,782, 3,945,063, 4,631,761, 4,747,170 and 4,761,841. However, these previously known devices do not include the overall combination of general structural and operational features of the instant invention nor some of the specific structural features thereof.

In addition, my own prior U.S. Pat. No. 4,220,241 discloses an items handler which utilizes a oscillating beam conveyor which is somewhat similar to the patient supporting and conveying portion of the instant invention.

SUMMARY OF THE INVENTION

The mechanical gurney of the instant invention includes a gurney chassis including front and rear pairs of opposite side wheel assemblies with each pair of wheel assemblies including one selectively driveable wheel assembly thereof. The front and rear pairs of wheel assemblies are, in addition, independently steerable through an angle of approximately 270 degrees and the gurney chassis includes an elevatable and tiltable upper platform from which an oscillating beam conveyor assembly is supported for lateral extension and retraction relative to one side of gurney.

The gurney has been specifically designed to function to engage beneath, lift and transport a reclining patient from one location to another with minimal disturbance to the patient's body and the gurney is of relatively simple construction and may be battery powered through the utilization of conventional rechargeable batteries of sufficient capacity to enable daily usage of the gurney on a single charge of its rechargeable batteries.

The main object of this invention is to provide a mechanical gurney which will be capable of gently engaging beneath, lifting and transferring a patient from a bed to the gurney.

Another object of this invention is to provide a gurney which can be readily maneuvered through hallways and onto and off elevators by a single operator.

Still another important object of this invention is to provide a mechanical gurney which also will be capable of gently transferring a patient therefrom onto a bed or other suitable support in an operating or treatment suit.

A further object of this invention is to provide a mechanical gurney having a drive system incorporating a variable speed electric motor, or the equivalent, drivingly connected to the drive wheels of the gurney through worm gearing, whereby breaking of the gurney during movement down an incline may be readily controlled by the drive motor, alone, and stationary breaking of the gurney may be accomplished merely by terminating the supply of electrical current to the variable speed motor.

Still another object of this invention is to provide a drive system for the oscillating beam conveyor assembly of the gurney which may be selectively actuated and deactuated in response to lateral extension and/or retraction of the oscillating beam conveyor assembly relative to the gurney chassis.

A final object of this invention to be specifically enumerated herein is to provide a mechanical gurney in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
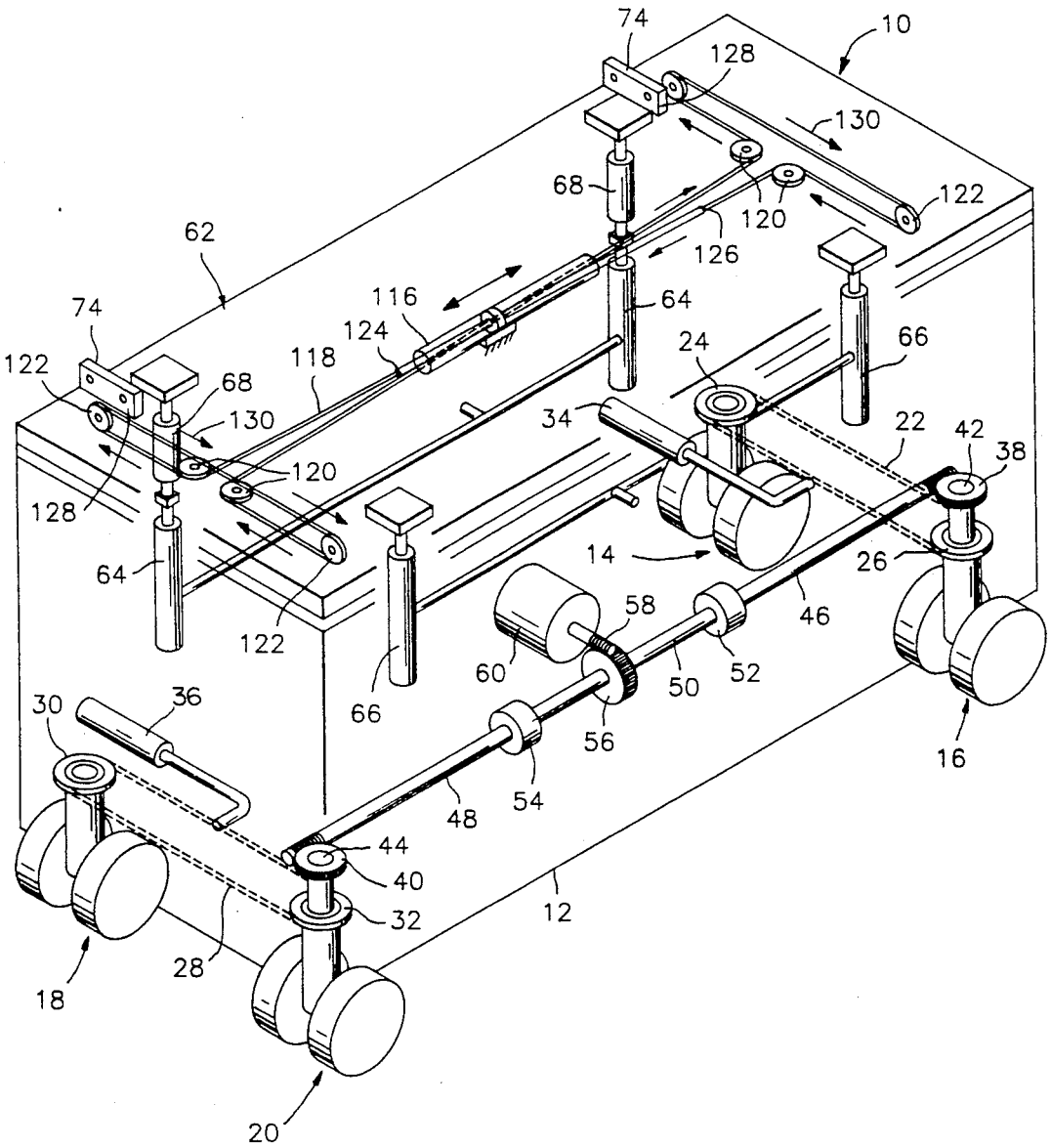
FIG. 1 is a schematic perspective view of the mechanical gurney of the instant invention with the oscillating beam conveyor assembly thereof omitted.

Referring now more specifically to the drawings the numeral 10 generally designates the patient carrying and transferring gurney of the instant invention. The gurney 10 includes a base or chassis 12 from which a pair of front opposite side wheel assemblies referred to in general by the reference numerals 14 and 16 are supported for angular displacement about upstanding axis. In addition, the base or chassis 12 includes a corresponding pair of rear opposite side rear assemblies referred to in general numerals 18 and 20 which are also supported from the base or chassis 12 for angular displacement about upstanding axes.

A front chain 22 is trained about sprockets 24 and 26 carried the wheel assemblies 14 and 16 for thereby interconnects the wheel assemblies 14 and 16 for simultaneous steering oscillation about the corresponding axis.

In addition, a similar chain 28 is trained about sprockets 30 and 32 carried by wheel assemblies 18 and 20 whereby these wheel assemblies also are linked together for simultaneous steering angular displacement.

Any suitable type of linear actuator such as double acting hydraulic cylinders 34 and 36 are interconnected between the base or chassis 12 and the adjacent reaches of the chains 22 and 28 and may be selectively actuated either independently of each other, in unison, actuated alike or actuated inversely by any suitable control (not shown).

The wheel assemblies 16 and 20 are driven by worm wheels 38 and 40 mounted upon input drive shafts 42 and 44 of the wheel assemblies 16 and 20 and the worm wheels 38 and 40 have worm gear shafts 46 and 48 meshed therewith. Adjacent ends of the worm gear shafts 46 and 48 are drivingly connected to opposite ends of an intermediate shaft 50 through the utilization of selectively actuatable clutches 52 and 54 and the longitudinal central portion of the intermediate shaft 50 has a worm wheel 56 mounted thereon with which the worm gear output shaft 58 of a variable speed electric motor 60 is meshed.

Because of the multiple worm gear drives between the electric motor 60 and the wheel assemblies 16 and 20, the gurney 10 may be gradually accelerated and gradually braked merely by varying the speed of operation of the motor 60. In addition, when the motor 60 is deactivated and at least one of the clutches 52 and 54 in engaged, the gurney 10 is stationarily braked.

The gurney 10 further includes an upper support structure referred to in general by the reference numeral 62 mounted from the base or chassis 12 through the utilization of selectively actuable pairs of opposite side hydraulic cylinders 64 and 66 which are simultaneously operable and, in addition to slide of the support structure 62 being supported from the cylinder 64, a second pair of cylinders 68, which are simultaneously actuable, are connected between the cylinders 64 and the support structure 62. Accordingly, the cylinders 64 may be simultaneously actuated to raise and lower the support structure 62 and the cylinder 68 are actuable independent of actuation of the cylinders 64 and 66 and may be used to angle or level the support structure 62 relative to the base or chassis 12 either during or independent of actuation of the cylinders 64 and 66.

Figure 2:
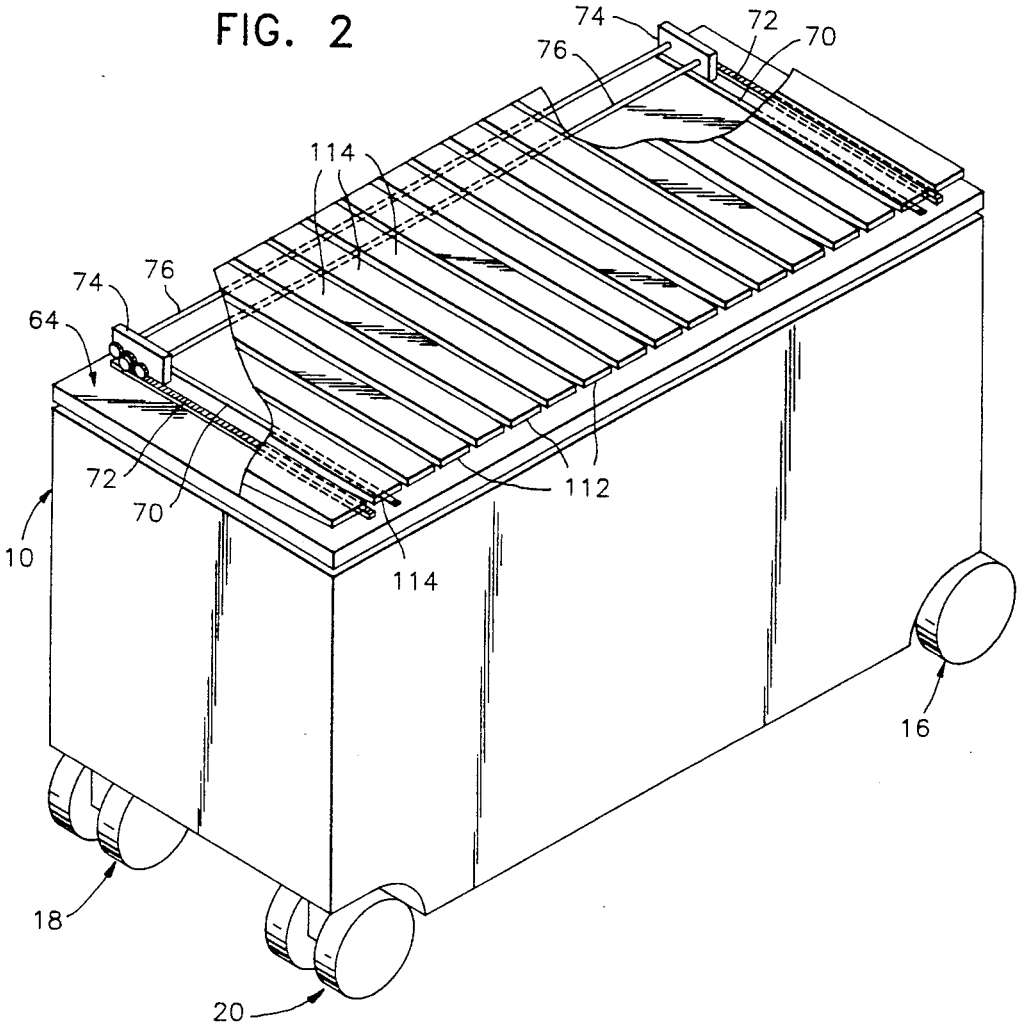
FIG. 2 is a perspective view of the mechanical gurney similar to FIG. 1 and illustrating portions of the oscillating beam conveyor assembly supported from the gurney in a fully laterally inwardly retracted position relative to the gurney.

With attention now invited more specifically to FIGS. 1 and 2, the support structure 62 mounts guide tracks 70 and rack gears 72 from the opposite ends thereof with the guide tracks 70 and the rack gears 72 extending transversely of opposite ends of the support structure 62. A pair of carriages 74 are mounted from the guide tracks 70 for movement along the latter as well as the rack gear 72 and a pair of cam shafts 76 having sets of first and second lobe discs 78 and 80 are rotatably mounted thereon. The discs 78 and 80 are circular and offset 180 degrees out of phase with each other on their respective shafts 76.

Figure 4:
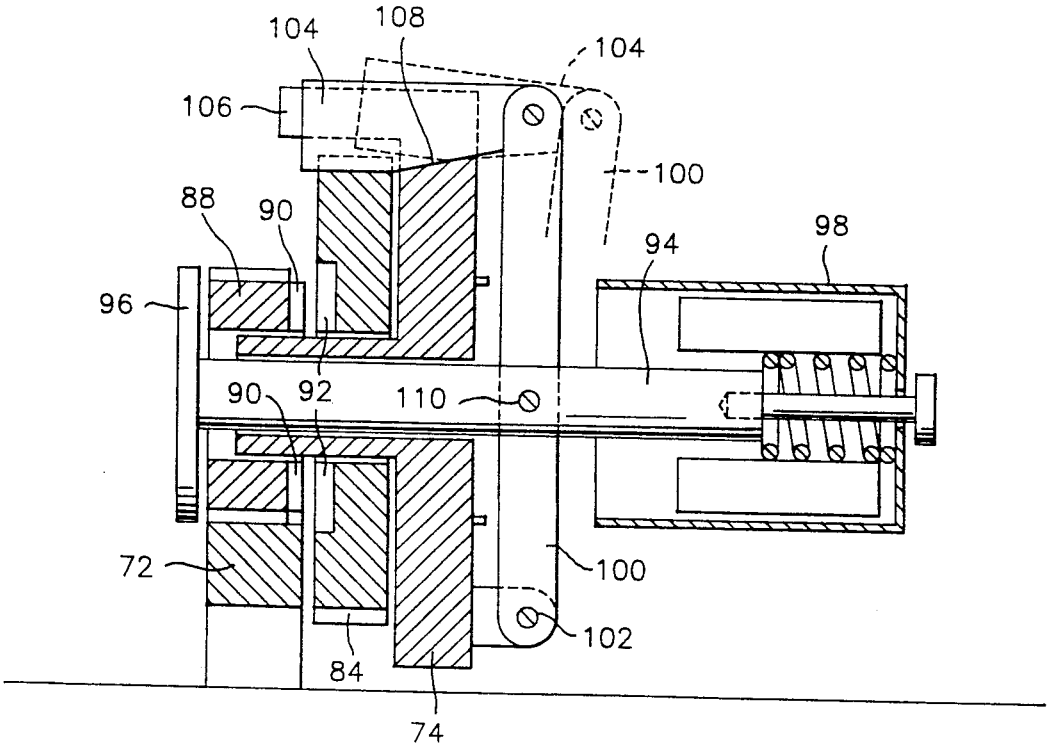
FIG. 4 is an enlarged vertical sectional view taken substantially upon the plane indicated by the section line 4—4 of FIG. 3.

The carriages 74 are guidingly engaged with the guide tracks 70 by guide rollers 82 and each carriage 74 journals a cam drive gear 84 therefrom meshed with gears 86 carried by the adjacent ends of the cam shafts 76. Also, a driven gear 88 is journaled from each carriage 74 and is meshed with the corresponding rack gear 72. Each driven gear 88 includes a pair of diametrically opposite radially extending teeth 90 which are alignable with and receivable within radial grooves 90 formed in the opposing outer face of the corresponding cam drive gear 84 and each carriage 74 includes a solenoid armature 94 slidably received therethrough and provided with an outer end head 96 engagable with the corresponding driven gear 88 to displace the latter inwardly into engagement with the corresponding cam drive gear 84, the solenoid armature 94 comprising a part of a solenoid 98 carried by each carriage 74. Further, each carriage 74 includes a lever 100 having one end pivotally supported from the carriage 74 as at 102 and including a pivoted latch (gravity or spring-operated) on its opposite end. Each latch 104 is received in a transverse slot 106 provided therefor in the corresponding carriage 74 and is engagable, when positioned as shown in solid lines in FIG. 4, between adjacent teeth of the corresponding cam drive gear 84. However, the slot 106 includes an inclined cam surface 108 and the intermediate length portion of the lever 100 is pivotally pinned, as at 110, to the corresponding solenoid armature 94. When the solenoid armature 94 is magnetically attracted to the right from the position thereof illustrated in FIG. 4, the level 100 assumes the phantom line position thereof illustrated in FIG. 4 and the latch 104 is pivoted to the phantom line position thereof illustrated in FIG. 4 to withdraw the latch 104 from the teeth of the cam drive gear 84.

Each pair of lobe discs 78 supports a support beam 112 therefrom while each pair of lobe discs 80 supports a support beam 114 therefrom.

With attention now invited more specifically to FIG. 1, it may be seen that the support structure 62 mounts a double acting cylinder 116 therefrom and that an elongated cable 118 is trained about various pulleys 120 and 122 journaled from the support structure 62 and has its opposite ends connected to oppositely extending piston rod ends 124 and 126 of the double acting cylinder 116. Further, the carriages 74 are each anchored to the cable 118 as at 128 such that shifting of the piston rod ends 124 and 126 to the left as viewed in FIG. 1 causes the carriages 74 to shift along the guide tracks 70 and the rack gears 72 in the direction of the arrows 130 while movement of the piston rod ends 124 and 126 to the right as viewed in FIG. 1 will cause reverse movement of the carriages 74.

Figure 3:
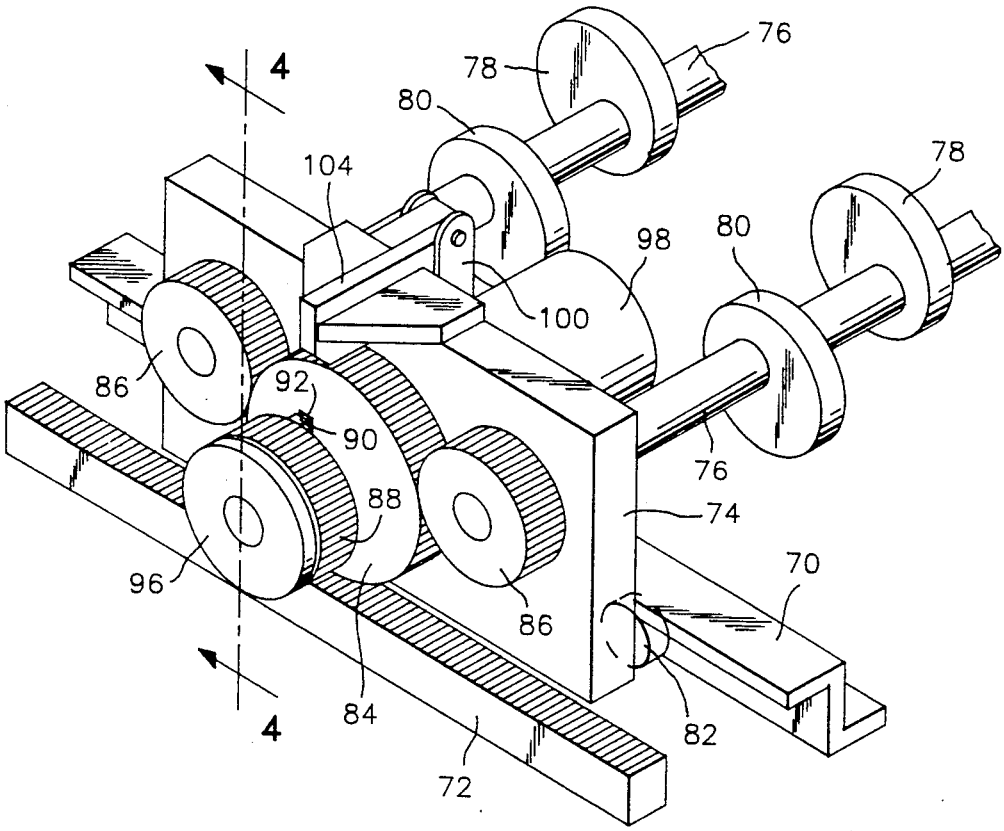
FIG. 3 is a fragmentary perspective view of the oscillating beam conveyor support assembly and conveyor beam actuating assembly.

When the carriages 74 are moved in the direction of the arrows 130 shown in FIG. 1, the cam drive gear 84 turns clockwise as viewed in FIG. 3 and thus causes the cam shafts 76 to rotate in a counterclockwise direction as viewed in FIG. 3. However, this occurs only when the solenoids 98 have been actuated in order to drivingly connect the driven gears 88 to the corresponding cam drive gears 84. Conversely, when the carriages 74 are moved in a direction opposite to the arrows 130, the cam drive gears 84 rotate counterclockwise and the cam gears 86 turn clockwise, here again only when the solenoids 98 are actuated.

When the solenoids 98 are not actuated, movement of the carriages 74 back and forth along the rack gears 72 merely results in rotation of the driven gears 88, the driven gears 88 being disconnected from the cam drive gears 84 and the latter being locked against rotation relative to the carriages 74 by the latch 104.

Figure 5:
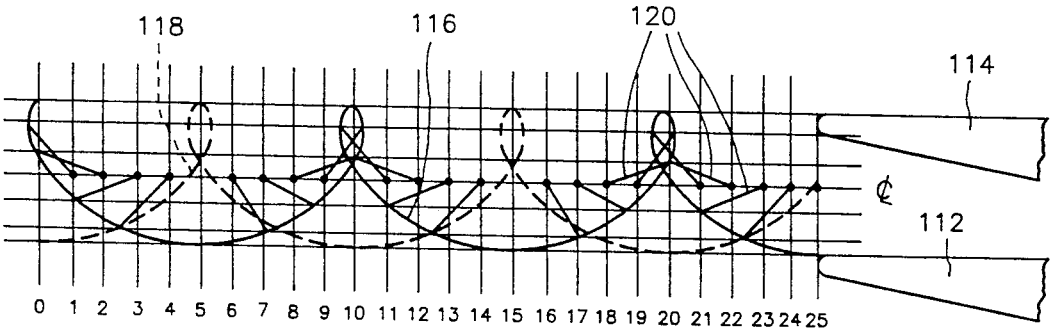
FIG. 5 is a diagrammatic view illustrating the movement of one pair of oscillating beams of the oscillating beam conveyor assembly during one complete revolution of the drive gear for the conveyor assembly during lateral extension of the conveyor assembly.

With attention now invited more specifically to FIG. 5, FIG. 5 illustrates, graphically, typical movement of the support beams 112 and 114 as the carriages 74 move along the guide tracks 70 and rack gears 72 with the solenoids 98 actuated.

The teeth on the rack gear 72 are 16 pitch and the driven gear 88 includes 24 teeth and the solid line 116 indicates the path through which the tip of the support beam 112 has moved during movement of the carriages 74 from left to right in FIG. 5 while the phantom line 118 indicates the movement of the end of the beam 114, the various lines 120 indicating the offset radius arm positions of the cam discs from which the beam 112 is supported. Of course, when the carriages 74 move from right to left as viewed in FIG. 5, movement of the beams 112 and 114 is reversed.

Figure 6:
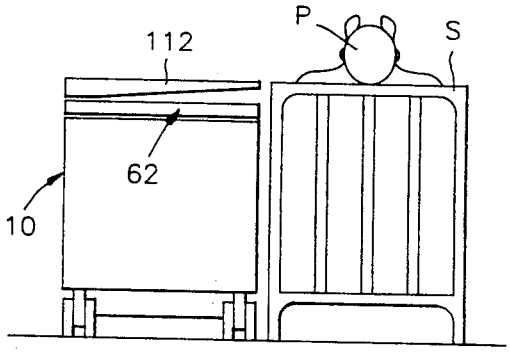
FIGS. 6–11 are sequential schematic views illustrating the manner in which the mechanical gurney may be placed along side a patient support and utilized to pick the patient up from the patient support and transfer the patient to the mechanical gurney.
Figure 7:
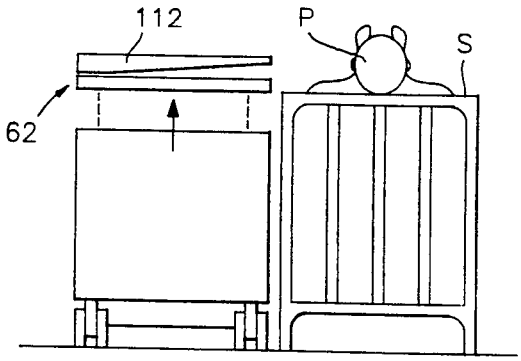
Figure 8:
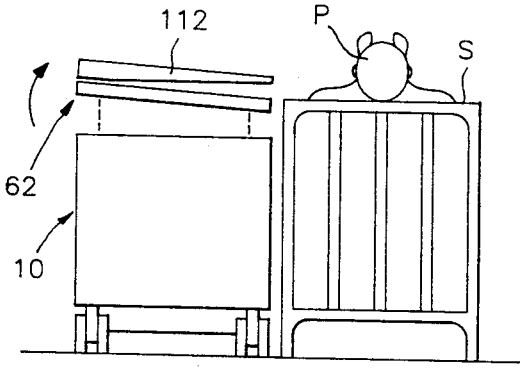
Figure 9:
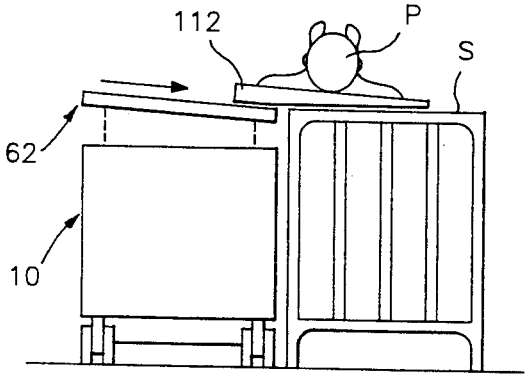

With attention now invited more specifically to FIGS. 6 through 11, from FIG. 6 it may be seen that the gurney 10 is first positioned alongside a patient support structure "S" with the patient "P" resting thereon. After the gurney 10 has been properly positioned as illustrated in FIG. 6, the support structure 62 is raised by actuation of the cylinder 64 and 66 until the support structure 62 is in the elevated thereof illustrated in FIG. 7. Then, the cylinders 68 may be actuated to tilt the support structure to the position thereof illustrated in FIG. 8 and the cylinder 116 may then actuated to move the carriages 74 to the right as viewed in FIG. 8 in order to extend the support beams 112 and 114, the solenoids 98 initially being deactivated. As the tips of the support beams 112 and 114 become positioned immediately adjacent the patient 108, the solenoids 98 are actuated during further extension of the support beams 112 and 114 to the right as viewed in FIGS. 8 and 9, whereupon the support beams 112 and 114 will wedge beneath the patient to raise and move the patient along the support beams 112 and 114 to the left in relation thereto as the support beams 112 and 114 are further extended to the right. Thereafter, with attention to FIG. 10, the cylinders 68 again are actuated to level the support structure and the support beams 112 and 114 and the cylinder 116 is actuated to retract the carriages 74 to the left as viewed in FIGS. 9 and 10 without the solenoids 98 being actuated.

Figure 10:
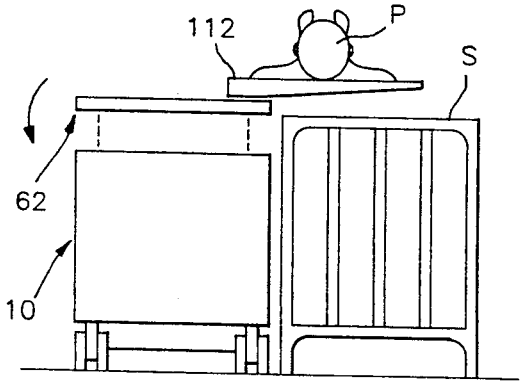
Figure 11:
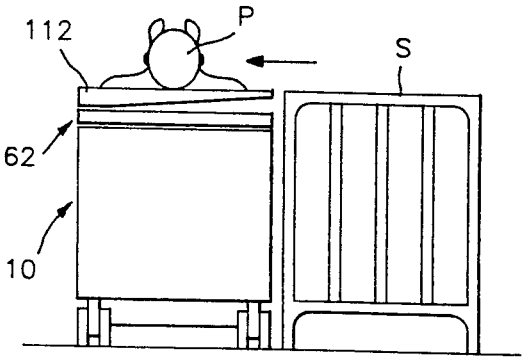

As soon as the carriages 74 have reached their limits of movement to the left as viewed in FIG. 10, the cylinders 64 and 66 are again actuated to lower the support structure 62 back down to the starting position thereof illustrated in FIG. 6 and 11. By this process patient "P" has been picked up from and transferred to the gurney 10 disposed alongside the support "S". Further, it is believed apparent that reverse procedural steps are followed when it is desired to transfer the patient "P" from the gurney 10 to the support "S" or any other substantially horizontal support.

It is to be noted that the cam shafts 76, when the solenoids 98 are actuated and the carriages 74 are moved along the rack gear 72, turn at twice the speed of the driven gears 88 and that the eccentric mounting of the lobe discs 78 and 80 on the cam shafts 76 is such that when the beams 112 and 114 are being extended beneath the patient "P", the oscillating action of the support beams 112 and 114 on the patient "P" is such that the patient "P" is moved toward the gurney 10, in relation to the support beams 112 and 114, at substantially the same speed the support beams 112 and 114 are being extended away from the gurney 10.

Further, it is to be noted that when the solenoids 98 are actuated, the heads 96 engage and shift the driven gears 88 into engagement with the cam drive gears 84 until the teeth 90 (during rotation of the driven gear 88 relative to the cam drive gear 84) seat in the grooves 92 of the cam drive gears 84 to thereby drivingly connected the driven gears 88 to the cam drive gears 84. Still further, since the lobe discs 78 and 90 are 180 degrees out of phase with each other, when the cam discs 78 and 80 are horizontally offset relative to the cam shafts 76 the support beams 112 and 114 are horizontally registered with each other and define a support table which will be comfortable for the patient "P" to lie upon. Of course, when it is desired that the support beams 112 and 114 be locked in horizontal registry with each other, as they approach horizontally registered positions, the solenoids 98 are deactuated to thereby simultaneously uncouple the driven gears 88 from the drive cam gears 84 and the latch the cam drve 84 against rotation relative to the carriages 74.

While the rack gear teeth 72 is said to be 16 pitch, all of the gear ratios may be altered to change the dimensions of the motion of the beam tips 112 and 114 in FIG. 5.

What is claimed as new is as follows:

1. A patient carrying and transferring gurney, said gurney including a wheeled frame, support structure including opposite margins and being mounted from said frame for adjusted elevational shifting relative thereto and adjustable angular displacement relative to said frame about a horizontal axis generally paralleling said opposite side margins, patient support means carried by said support structure for elevational and angular adjustment therewith relative to said frame, means mounting said patient support means from said support structure for adjusted generally horizontal displacement relative to said support structure along a first predetermined path extending laterally of said axis between a first retracted position superposed over said support structure and a second extended position projecting outwardly of one of said side margins, said patient support means including patient conveyor means supported therefrom operative to support and convey a patient thereon back and forth along a second path generally paralleling said first path.

2. The gurney of claim 1 including selectively deactuable drive means for said conveyor means operative to inversely drive said conveyor means responsive to extension and retraction of said patient support means relative to said one side margin.

3. The gurney of claim 2 wherein said drive means includes an deactivatable drive connection between said support structure and said patient support means for inversely driving said conveyor means responsive to movement of said patient support means back and forth along said first path.

4. The gurney of claim 3 wherein said drive connection and said conveyor means include coacting means operative to convey a patient along said conveyor means in a direction opposite to the direction said patient support means is shifted relative to said support structure.

5. The gurney of claim 4 wherein said coacting means includes means operative to convey a patient along said conveyor means at a speed at least substantially equal to the speed of shifting of said patient support means relative to said support structure.

6. The gurney of claim 3 wherein said conveyor includes a plurality of horizontal, alternate first and second side-by-side spaced apart and elongated support bars mounted from said patient support means for inverse, orbital cyclic movement in a vertical plane relative to said patient support means.

7. The gurney of claim 1 wherein said wheeled frame includes front and rear pairs of opposite side support wheels and means for selectively driving at least one wheel of each pair of wheels.

8. The gurney of claim 7 wherein said support wheels are mounted from said frame for steering angular adjustment about upstanding axis, means operatively connected between said frame and each pair of wheels for steering adjustment thereof independent of steering adjustment of the other pair of wheels.

9. In combination, generally horizontal support structure having opposite side margins, patient support means mounted from said patient support structure for adjusted generally horizontal displacement relative thereto along a first predetermined path disposed at generally right angles relative to said opposite side margins between a first retracted position superposed over said support structure and a second extended position projecting outwardly of one of said side margins, said patient support means including patient conveyor means supported therefrom and operative to support and convey a patient thereon back and forth along a second path generally paralleling said first path.

10. The combination of claim 9 including selectively deactutable drive means for said conveyor means operative to inversely drive said conveyor means responsive to extension and retraction of said patient support means relative to said one side margin.

11. The combination of claim 10 wherein said drive means includes an deactivatable drive connection between said support structure and said patient support means for inversely driving said conveyor means responsive to movement of said patient support means back and forth along said first path.

12. The combination of claim 11 wherein said drive connection and said conveyor means includes coacting means operative to convey a patient along said conveyor means in a direction opposite to the direction said patient support means is shifted relative to said support structure.

13. The combination of claim 12 wherein said coacting means includes means operative to convey a patient along said conveyor means at a speed at least substantially equal to the speed of shifting of said patient support means relative to said support structure.

14. The combination of claim 13 wherein said conveyor includes a plurality of horizontal, alternate first and second side-by-side spaced apart and elongated support bars mounted from said patient support means for inverse, orbital cyclic movement in a vertical plane relative to said patient support means.

* * * * *